US009422807B2

(12) United States Patent
Goodwin et al.

(10) Patent No.: US 9,422,807 B2
(45) Date of Patent: Aug. 23, 2016

(54) ACOUSTIC DETERMINATION OF THE POSITION OF A PISTON WITH BUFFER RODS

(71) Applicant: Schlumberger Technology Corporation, Sugar Land, TX (US)

(72) Inventors: Anthony R. H. Goodwin, Sugar Land, TX (US); Jason S. Milne, Orsay (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 235 days.

(21) Appl. No.: 13/935,243

(22) Filed: Jul. 3, 2013

(65) Prior Publication Data

US 2015/0007652 A1 Jan. 8, 2015

(51) Int. Cl.
*E21B 47/10* (2012.01)
*E21B 49/08* (2006.01)

(52) U.S. Cl.
CPC ..... *E21B 47/101* (2013.01); *E21B 49/08* (2013.01)

(58) Field of Classification Search
CPC ..... E21B 47/101
USPC ..... 73/152.55, 152.58
See application file for complete search history.

(56) References Cited

U.S. PATENT DOCUMENTS 4,938,054 A * 7/1990 Dye et al. ..... 73/1.21
6,112,599 A * 9/2000 Maki, Jr. ..... 73/801
6,119,579 A * 9/2000 Pawelski ..... 92/5 R
6,435,279 B1 * 8/2002 Howe et al. ..... 166/336
6,848,323 B2 * 2/2005 Krouth et al. ..... 73/861.47
7,062,958 B2 6/2006 Diakonov et al.
9,260,963 B2 2/2016 Goodwin et al.
2002/0083826 A1 * 7/2002 Arshad et al. ..... 92/5 R
2015/0007986 A1 1/2015 Goodwin et al.

FOREIGN PATENT DOCUMENTS

GB 2377952 A 1/2003

OTHER PUBLICATIONS

Chen, et al. "Cross pressure and temperature derivatives of selected elastic moduli for olivine from gigahertz ultrasonic Interferometry," Journal of Geophysical Research, vol. 101, No. B11, pp. 25161-25171, Nov. 10, 1996.
Fujii, K., et al, "Accurate Measurements of the sound velocity in pure water by combining a coherent phase-detection technique and variable path-length interferometer", J. Acoust. Soc. 93, pp. 276-282, 1993.
Goto, T. , et al, "Apparatus for measuring elastic constants of single crystals by a resonance technique up to 1825 K", Review of Scientific Instruments 59, 1405, 1988, 5 pgs.
Lu, Z., et al, "Phase comparison technique for measuring liquid-liquid phase equilibrium", Review of Scientific Instruments 70, 2065, 1999, 5 pgs.

* cited by examiner

*Primary Examiner* — J M Saint Surin
(74) *Attorney, Agent, or Firm* — Kenneth L. Kincaid

(57) ABSTRACT

An apparatus having a transducer configured to generate acoustic energy, a buffer rod with a first end and a second end, the transducer in contact with the first end, a cylinder configured to define a volume, the second end of the buffer rod abutting the cylinder; and a piston within the cylinder.

15 Claims, 2 Drawing Sheets

ACOUSTIC DETERMINATION OF THE POSITION OF A PISTON WITH BUFFER RODS

CROSS-REFERENCE TO RELATED APPLICATIONS

None.

FIELD OF THE INVENTION

Aspects relate to use of acoustics associated with underground formation analysis. More specifically, aspects relate to acoustic determination of piston position with buffer rods for downhole formation analysis systems and methods.

BACKGROUND INFORMATION

A Modular Dynamics Tester (MDT) is an instrument used to acquire aliquots of reservoir fluid for analyses and transportation. The reservoir fluid is drawn into the MDT through a probe in-contact with the bore-hole wall by reducing the pressure within the MDT tubular, which contains bore-hole fluid, from the pressure of the formation. The pressure reduction is generated by a positive displacement pump operated by hydraulic fluid. This is a positive displacement pump that has two pistons within a cylinder wherein one piston contacts a hydraulic fluid and the other piston contacts the flow-line fluid.

The position of the piston is not determined as a function of displacement. When the fluid within the tubular is free of drilling fluid, as determined by the interpretation of independent measurements on the flow-line, the reservoir fluid is directed into the sample bottle. The position of the piston within the sample bottle and thus the intake of fluid are not currently determined.

Prior art methods and apparatus determine the quantity of hydraulic or lubricating fluid contained within a compensator using sound speed measurements. This measurement is required because the hydraulic fluid is continually ejected in the bore-hole through rotary shaft-seals. This approach is shown schematically in FIG. 1.

Referring to FIG. 1, a cross-section through the bellows C and pressure vessel containing either hydraulic or lubricating fluid A is used in a reservoir fluid sampling-while-drilling instrument. An acoustic transducer T is mounted flush with the inner surface of the pressure vessel. The sound is reflected, by the acoustic impedance mis-match, at the metallic surface R of the bellows and travels a distance 2,/before arrival at the transducer T that is now acting as a receiver. The surface R is on a bellows that is parallel with the surface of T and moves within the cylinder A. The bellows serves to both separate the MUD from the hydraulic or lubricating fluid and transmit the pressure within the bore-hole to the hydraulic and lubricating fluids.

In an alternative prior art configuration, illustrated in FIG. 2, an apparatus is described to determine the position of the pump piston surface utilizing measurements of the time of flight of a pulse of sound combined with knowledge of the speed of sound. In FIG. 2, a cross-section through a displacement pump used to move reservoir and bore-hole fluid B with a hydraulic fluid A is provided. An acoustic transducer T is mounted flush with the screen surface S. The sound is reflected due to the acoustic impedance mismatch, at the metallic surface R and travels a distance 2/ before arrival at the transducer T that is now acting as a receiver.

The surface R is on a piston that is parallel with the surface of T and moves within the cylinder C.

In another prior art alternative embodiment, an apparatus is described to determine the position of the piston surface within a sample bottle, shown schematically in FIG. 3, from measurement of the time of flight of a pulse of sound combined with knowledge of the speed of sound.

A cross-section through a sample bottle used to transport reservoir fluid E containing hydraulic fluid A is illustrated in FIG. 3. This particular bottle is used in the Modular Dynamics Tester. An acoustic transducer T is mounted flush with the surface S. The sound is reflected, by the acoustic impedance mismatch, at the metallic surface R and travels a distance 2/ before arrival at the transducer T that is now acting as a receiver. The surface R is on a piston that is parallel with the surface of T and moves within the cylinder F. Although not shown, the sample bottle is also fitted with measurements of temperature and pressure.

Conventional systems and methods utilize a time-of-flight determination of the distance separating a transducer and reflector within a fluid for which the sound speed is known. The choice of this method, wherein the transducer used both emits and detects the acoustic wave, is mounted directly into one end of the pressure vessel. This approach requires a method to interconnect the transducer with the processing electronics that might require either wire or wireless communication. For the case of the pump shown in FIG. 3, the cylinder is external to the main apparatus and it is located within a bay that is exposed to bore-hole fluid. This arrangement significantly reduces the time required to exchange one pump for another. Any connection between the transducer and the tool housing would require wires and electrical feedthroughs that both offer additional potential failure modes for operation of the apparatus.

SUMMARY

In one example embodiment, an apparatus is disclosed comprising: a transducer configured to generate acoustic energy, a buffer rod with a first end and a second end, the transducer in contact with the first end, a cylinder configured to define a volume, the second end of the buffer rod abutting the cylinder, and a piston within the cylinder.

DETAILED DESCRIPTION

Figure 1:
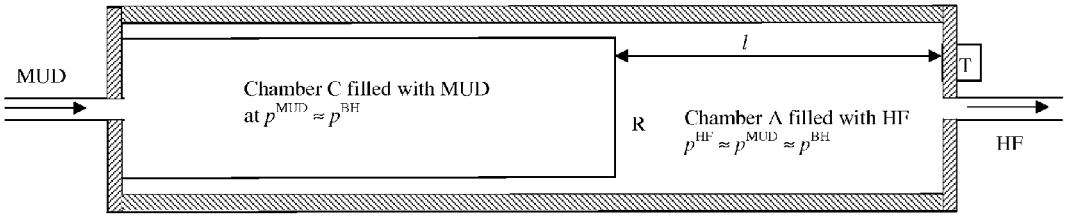
FIG. 1 is a prior art apparatus that is used to determine the quantity of hydraulic or lubricating fluid contained within a compensator using sound speed measurements.
Figure 2:
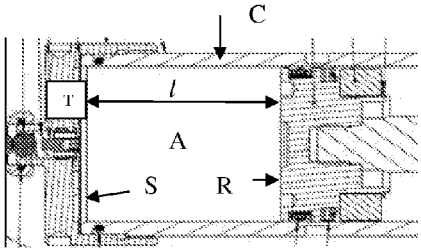
FIG. 2 is a prior art apparatus that is used to determine the quantity of hydraulic or lubricating fluid contained within a compensator using sound speed measurements.
Figure 3:
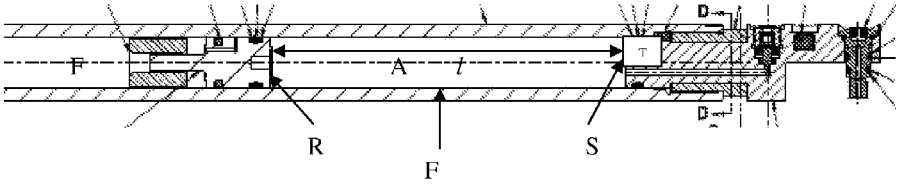
FIG. 3 is a prior art apparatus that is used to determine the quantity of hydraulic or lubricating fluid contained within a compensator using sound speed measurements.

Aspects described allow for the elimination of the exposure of the transducer to chemically aggressive media at elevated temperature and pressure by use of a buffer rod or by the configurations illustrated. Additionally, the use of buffer rods permits the transducer to be located within the tool housing and thus operates within air at essentially ambient pressure thus negating the requirement for an acoustic (sound) transducer that functions in a high-pressure fluid.

The transducers that convert mechanical work into electrical work or vice versa, and are thus required to generate and detect sound, are an important component of an apparatus to measure the speed of sound. The transducers used satisfy certain criteria before the transducers are useful for the measurements proposed. The transducers have low output power so as not to perturb thermal equilibrium within the cavity, operate over a wide temperature and pressure range and when exposed to the fluid are chemically inert while also maintaining an acceptable signal-to-noise ratio.

One method of separating the transducer from the sample is to attach the element to one end of a rod, constructed from a material that has the appropriate acoustic and thermal properties, and the other end of the rod exposed to the sample. This buffer rod arrangement may be used successfully for measurements of the speed of sound in both liquids and solids. The difference in phase between each echo and the continuous wave reference, used to generate the pulse, can be determined with phase sensitive detectors or from measurements as a function of varying path length. The difference in distance travelled between the two echoes d is determined by the number of half wavelength constructive interference in the fluid or fringes Fat a frequency given by the below equation:

$$F = \frac{d}{\lambda} = n + \frac{1}{2} + \frac{\theta_2 - \theta_1}{2\pi},$$

where $\lambda$ is the wavelength, n is an integer number of fringes, ½, describes the phase change on reflection at the interface between the buffer and the fluid, $\theta$ is the phase difference between the pulse and the continuous wave reference, and the subscripts 1 and 2 refer to the first and second echo respectively. The wavelength is then determined from the change in path length d required to observe an additional fringe. In practice, the path length is changed over about 100 fringes. The speed of sound is then determined from the wavelength and the frequency.

The Modular Dynamics Tester (MDT) is used to acquire aliquots of reservoir fluid for analyses and transportation. The reservoir fluid is drawn into the MDT through a probe in contact with the bore-hole wall by reducing the pressure within the MDT tubular, which initially usually contains bore-hole fluid, from the pressure of the formation. The pressure reduction may be generated by a positive displacement pump operated by hydraulic fluid, as a non-limiting example. When the fluid within the tubular is essentially free of drilling fluid, as determined by the interpretation of independent measurements on the flow-line, the reservoir fluid is directed into the sample bottle. Both the pump and sample bottle use pistons moving within a cylinder. Continuous measurements of piston location on the hydraulic side provides operators with a method to determine that the bottle is functioning and acquiring fluid while on the sample side determine phase equilibrium and thus sample validation. For a sample bottle, this bottle permits direct determination of the acquisition of a reservoir fluid sample.

The piston position can be determined from measurements of the time-of-flight of a sound wave within a fluid, for example, the hydraulic substance, for which the speed of sound is known as a function of temperature and pressure. This general approach requires wires and electrical feedthroughs to interconnect the transducer to the apparatus and thus the processing electronics and ultimately provide communication of the piston position to the operator of the apparatus whom is located at the surface while the apparatus may be >1 km beneath the Earth's crust; this is certainly significant for both the pump and sample bottle applications. The wires and electrical feedthroughs can be eliminated by the use of buffer rods. More significantly, the use of buffer rods, separates the transducer itself from the high pressures within the borehole and thus permits use of transducers within the housing that are surrounded by air that, at the surface, was at ambient pressure.

This is design parameter is important because designing transducers to operate within high pressure fluid requires a system that can both service the forces exerted by the pressure on the transducer face and an almost mutually exclusive requirement that the transducer backing is slightly elastic. This matter can be overcome by the use of a pressure-balanced transducer housing, but doing so is mechanically complex and requires space. The buffer rod completely separates the transducer from the high pressure environment, providing a significantly simpler transducer design. A piezoelectric ceramic may be adhered with glue to the end of the rod within the tool without additional mechanical components.

Figure 4:
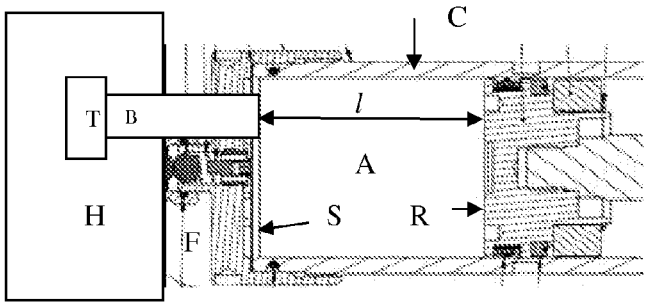
FIG. 4 is a first embodiment connecting a sound source to a detector through the use of a buffer rod.

There are numerous configurations that use buffer rods interconnecting the sound source and detector to the fluid. Three examples are provided. In the first configuration, which is shown in FIG. 4, an acoustic transducer T is mounted within the apparatus tubular with both the processing electronics and communication systems (both not shown) to a buffer rod B that passes through the housing of the apparatus and through the end-cap of the cylinder containing the pump piston R. In an alternative arrangement, shown in FIG. 5, the acoustic transducer T is mounted within the apparatus tubular again with both the processing electronics and communication systems (both not shown) and connected to a buffer rod B1 that passes through the housing of the apparatus and is immersed in the bore-hole fluid F that surrounds the pump. Buffer rod B1 is placed close ($<\lambda/10$, where $\lambda$ is the wave-length) to another buffer rod B2 in the bore-hole fluid. This arrangement permits simple removal and replacement of the pump or the sample bottle. The buffer rods B1 and B2 can, but not necessarily so, be formed from the same material. For a frequency of 1 MHz and a sound speed of 1 000 $m \cdot s^{-1}$ $\lambda/2=0.1$ mm and the separation between B1 and B2 must be <0.1 mm; this mechanical clearance can be achieved, for example, with semi-flexible rods.

Referring to FIG. 4, a cross-section through a displacement pump is illustrated to move reservoir and bore-hole fluid F with a hydraulic fluid A. This displacement unit is used in a Modular Dynamics Tester. An acoustic transducer T is mounted within the apparatus tubular H with both the processing electronics and communication systems (both not shown) to a buffer rod B that passes through the housing of the apparatus and through the end-cap of the cylinder containing the pump piston R. The surface R is on a piston that is parallel with the surface of T and moves within the cylinder C.

Figure 5:
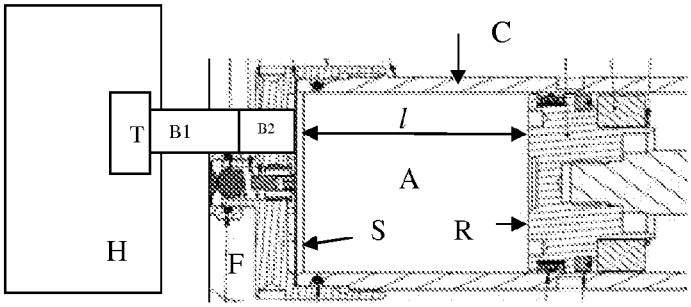
FIG. 5 is a second embodiment connecting a sound source to a detector through the use of two buffer rods.

Referring to FIG. 5, a cross-section through a displacement pump is illustrated to move reservoir and bore-hole fluid F with a hydraulic fluid A. This displacement unit is used in the Modular Dynamics Tester. An acoustic transducer T is mounted within the apparatus tubular H with both the processing electronics and communication systems (both not shown) to a buffer rod B1 that passes through the housing of the apparatus and is immersed in the bore-hole fluid F that surrounds the pump. The buffer rod B1 is placed close (<λ/2, where λ is the wave-length) with another buffer rod B2. This arrangement permits simple removal and replacement of the pump or the sample bottle. The buffer rods B1 and B2 can, but not necessarily so, be formed from the same material. For a frequency of 1 MHz and a sound speed of 1 000 m·s-1 λ/2=0.5 mm and the separation between B1 and B2 must be <0.5 mm.

Figure 6:
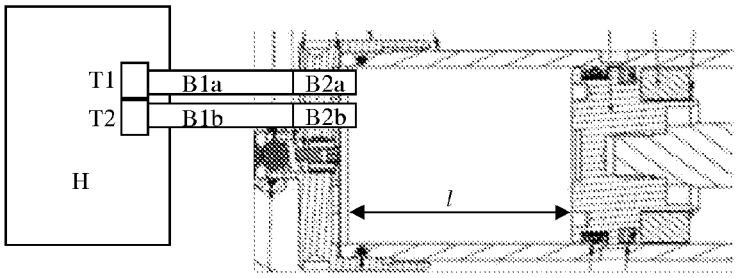
FIG. 6 is a third embodiment connecting a sound source to a detector through the use of two buffer rods, one buffer rod for the sound source and one buffer rod for the detector/receiver.

In an alternative configuration, two buffer rods, one for a transmitter the other a receiver are used as shown in FIG. 6. This configuration avoids the use of one rod to transmit the sound that includes reflections of large-amplitude echoes from the interfaces that might ultimately swamp the desired reflection from the piston surface.

The buffer rod introduces an additional design requirement over that of a transducer in that for time-of-flight measurements, there is a requirement to distinguish between two signals: one that arises from the reflection of the piston and the other, undesired, reflection that occurs at the interface between the rod and the liquid, in this case bore-hole fluid. In particular, this is the case when the unwanted reflection is of the same order of magnitude or larger than the desired refection (echo). To reduce this source of error, the acoustic impedance of the buffer rod is matched to that of the liquid in which it is immersed eliminating reflections at the interface between the rod and liquid.

For bore-hole fluids for which the chemical composition varies and over the temperature pressure range experienced within a bore-hole, this approach cannot be fully achieved. Additionally, the requirement to operate the buffer rod in a chemically aggressive environment necessarily limits the materials that can be used to construct the buffer rod. The reflection at the rod fluid interface arises from the acoustic impedance Z mismatch at the interface; Z=pu where p is the density and u the sound speed of the material. For the case of steel, for which $p_s$=7 800 kg·m$^{-3}$ and $u_s$=6 000 m·s$^{-1}$, $Z_s$=47 Mkg·m$^2$·s$^{-1}$, in contact with water, for which $p_w$=1 000 kg·m$^{-3}$, and $u_w$=1 500 m·s$^{-1}$, $Z_w$=1.5 Mkg·m$^2$·s$^{-1}$ the reflection R and transmission T coefficients at the interface between water and steel can be obtained from $$R_{w,s} = \frac{Z_s - Z_w}{Z_s + Z_w} = 1 - T_{w,s} \text{ and,}$$

$$T_{w,s} = \frac{2Z_s}{Z_s + Z_w},$$

respectively, that gives the reflection at the interface between the rod and water to be about 94%.

Figure 7:
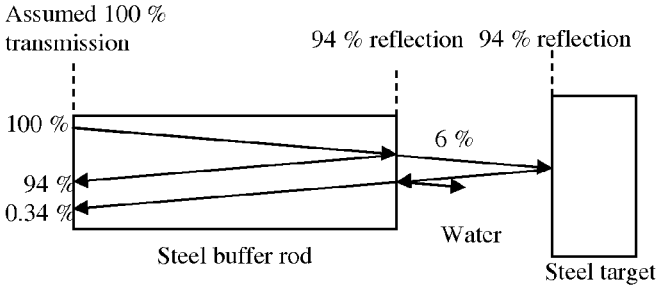
FIG. 7 is a depiction of main transmission and acoustic paths showing relative strength of echos for time of flight measurement calculations.

In view of the requirement, shown in FIG. 7, when a signal crosses this interface twice, the resultant is an very weak echo compared to the unwanted echo from the interface between the rod and liquid. FIG. 7 refers to an ideal case because the interface between the rod and transducer will also be imperfect and create additional reflections within the rod that will need to be distinguished from the desired echo. The use of two rods separated by a small but non-negligible distance (λ/10< d < λ/2) also creates an additional reflection that complicate the measurement.

Three approaches to improving the time-of-flight measurement with the system illustrated in FIG. 7 are as follows:

(1), Separate the transit time between the desired and undesired reflections (echoes) by making the rod sufficiently long so that the time between the first and second reflections within the rod is longer than the largest two-way travel time expected between the rod and the piston.

(2), Use a layer to match the acoustic impedance at the interface between the rod and fluid (anti-reflection coating) of depth a λ/4, with an impedance of $Z=\sqrt{Z_s Z_w}$ that for the case of an interface between steel and water that is approximately 8. While there is no material known with this Z value, fused quartz, for which Z=14 will yield a sufficiently large reduction in the reflection at this interface.

(3), Use two buffer rods, one for transmission and one for reception so that the first echo to arrive at the receiver is the desired echo, eliminating large-amplitude echoes. The main echo received at the source transducer yields the time of flight within the rod, which can be subtracted from the true echo measurement to give the transit time within the fluid only.

In one non-limiting embodiment, an apparatus is disclosed comprising: a transducer configured to generate acoustic energy, a buffer rod with a first end and a second end, the transducer in contact with the first end, a cylinder configured to define a volume, the second end of the buffer rod abutting the cylinder and a piston within the cylinder.

The apparatus may also be configured wherein the at least one surface of the piston is parallel with a surface of the transducer.

The apparatus may also be configured wherein the transducer is mounted with a tubular.

The apparatus may also further comprise an end cap connected to the cylinder wherein the buffer rod extends through the end cap.

In another non-limiting embodiment, an apparatus is disclosed comprising a transducer configured to generate acoustic energy, a first buffer rod with a first end and a second end, the transducer in contact with the first end of the first buffer rod; a second buffer rod with a first end and a second end wherein the first end of the second buffer rod is in contact with the second end of the first buffer rod, a cylinder configured to define a volume, the second end of the second buffer rod abutting the cylinder, and a piston within the cylinder.

In another embodiment, the at least one surface of the piston is parallel with a surface of the transducer.

In another embodiment, the transducer is mounted with a tubular.

In another embodiment the apparatus may further comprise an end cap connected to the cylinder wherein the second buffer rod extends through the end cap.

In another embodiment an apparatus is disclosed, comprising: a first transducer configured to generate acoustic energy; a first buffer rod with a first end and a second end, the first transducer in contact with the first end of the first buffer rod; a second buffer rod with a first end and a second end wherein the first end of the second buffer rod is in contact with the second end of the first buffer rod; a cylinder configured to define a volume, the second end of the second buffer rod abutting the cylinder; a piston within the cylinder;

a first receiver configured to sample acoustic energy; a first receiver buffer rod with a first end and a second end, the first receiver in contact with the first end of the first receiver buffer rod; and a second receiver buffer rod with a first end and a second end wherein the first end of the second receiver buffer rod is in contact with the second end of the first receiver buffer rod.

The apparatus may be configured wherein the at least one surface of the piston is parallel with a surface of the transducer.

The apparatus may be configured wherein the transducer is mounted with a tubular.

The apparatus may also further comprise an end cap connected to the cylinder wherein the second buffer rod and the second receiver buffer rod extend through the end cap.

In another example embodiment, a method for analyzing a downhole fluid is disclosed comprising activating a transducer to create at least one pulse of acoustic energy, transmitting the at least one pulse of acoustic energy through at least one buffer rod, imparting the energy into the downhole fluid, reflecting the acoustic energy back to the at least one buffer rod, receiving the acoustic energy at an apparatus; and calculating a time of flight for the acoustic energy.

In a further example embodiment, the method may be accomplished wherein the apparatus is an acoustic receiver.

In a still further example, the method may be accomplished wherein the reflecting the acoustic energy back to the at least one buffer rod is to a second receiver buffer rod.

While the aspects has been described with respect to a limited number of embodiments, those skilled in the art, having benefit of this disclosure, will appreciate that other embodiments can be devised which do not depart from the scope of the disclosure herein.

What is claimed is:

1. A downhole apparatus, comprising:

a transducer configured to generate acoustic energy;

a stationary buffer rod with a first end and a second end, the transducer in direct contact with the first end;

a cylinder configured to define a volume, the second end of the stationary buffer rod abutting the cylinder; and a piston within the cylinder.

2. The apparatus according to claim 1, wherein a flat surface of the piston is parallel with a surface of the transducer.

3. The apparatus according to claim 1, wherein the transducer is mounted within a tubular separate from the cylinder.

4. The apparatus according to claim 1, further comprising:

an end cap connected to the cylinder wherein the stationary buffer rod extends through the end cap.

5. A downhole apparatus, comprising:

a transducer configured to generate acoustic energy;

a first stationary buffer rod with a first end and a second end, the transducer in direct contact with the first end of the first stationary buffer rod;

a second stationary buffer rod with a first end and a second end wherein the first end of the second stationary buffer rod is in direct contact with the second end of the first stationary buffer rod;

a cylinder configured to define a volume, the second end of the second stationary buffer rod abutting the cylinder; and a piston within the cylinder.

6. The apparatus according to claim 5, wherein a flat surface of the piston is parallel with a surface of the transducer.

7. The apparatus according to claim 5, wherein the transducer is mounted within a tubular separate from the cylinder.

8. The apparatus according to claim 5, further comprising:

an end cap connected to the cylinder wherein the second stationary buffer rod extends through the end cap.

9. A downhole apparatus, comprising:

a first transducer configured to generate acoustic energy;

a first stationary buffer rod with a first end and a second end, the first transducer in direct contact with the first end of the first stationary buffer rod;

a second stationary buffer rod with a first end and a second end wherein the first end of the second stationary buffer rod is in direct contact with the second end of the first stationary buffer rod;

a cylinder configured to define a volume, the second end of the second stationary buffer rod abutting the cylinder;

a piston within the cylinder;

a first receiver configured to sample acoustic energy;

a first receiver buffer rod with a first end and a second end, the first receiver in direct contact with the first end of the first receiver buffer rod; and a second receiver buffer rod with a first end and a second end wherein the first end of the second receiver buffer rod is in direct contact with the second end of the first receiver buffer rod.

10. The apparatus according to claim 9, wherein a flat surface of the piston is parallel with a surface of the transducer.

11. The apparatus according to claim 9, wherein the transducer is mounted within a tubular separate from the cylinder.

12. The apparatus according to claim 9, further comprising:

an end cap connected to the cylinder wherein the second stationary buffer rod and the second receiver buffer rod extend through the end cap.

13. A method for analyzing a downhole fluid, comprising:

activating a transducer to create at least one pulse of acoustic energy;

transmitting the at least one pulse of acoustic energy through at least one stationary buffer rod;

imparting the energy into the downhole fluid;

reflecting the acoustic energy back to the at least one stationary buffer rod;

receiving the acoustic energy at an apparatus; and calculating a time of flight for the acoustic energy.

14. The method according to claim 13, wherein the apparatus is an acoustic receiver.

15. The method according to claim 13, wherein the reflecting the acoustic energy back to the at least one stationary buffer rod is to a second receiver buffer rod.

* * * * *